United States Patent [19]

Buckner

[11] 4,185,610

[45] Jan. 29, 1980

[54] FORCED AIR CHANNEL BAFFLES

[75] Inventor: Carrol E. Buckner, Weaverville, N.C.

[73] Assignee: Smoky Mountain Enterprises, Inc., Asheville, N.C.

[21] Appl. No.: 828,206

[22] Filed: Aug. 26, 1977

Related U.S. Application Data

[63] Continuation-in-part of Ser. No. 693,805, Jun. 7, 1976, Pat. No. 4,092,976.

[51] Int. Cl.[2] ..... F24C 1/14

[52] U.S. Cl. ..... 126/121; 126/63; 165/126; 165/174

[58] Field of Search ..... 237/51; 126/121, 62, 126/63, 61, 66; 219/365, 368, 369; 165/124, 126, 174

[56] References Cited

U.S. PATENT DOCUMENTS

| | | | |
|---|---|---|---|
| 1,562,349 | 11/1925 | Berry | 126/121 |
| 1,640,937 | 8/1927 | Heinish | 126/121 |
| 1,740,996 | 12/1929 | Muir | 126/121 |
| 3,190,282 | 6/1965 | Bauer | 126/121 X |
| 4,066,121 | 1/1978 | Kleine et al. | 165/174 X |

FOREIGN PATENT DOCUMENTS

| | | | |
|---|---|---|---|
| 617901 | 4/1961 | Canada | 126/121 |
| 440682 | 2/1912 | France | 126/121 |
| 135415 | 11/1919 | United Kingdom | 126/121 |

*Primary Examiner*—Lloyd L. King
*Assistant Examiner*—William E. Tapolcai, Jr.
*Attorney, Agent, or Firm*—Leitner, Palan, Martin & Bernstein

[57] ABSTRACT

A free-standing unit for heating air in a U-shaped channel surrounding a fire box having a pair of spaced vertical vents for directing the heated forced air to converge in front of the fire box opening to limit air flow towards said openings. Mesh in the vertical vents directs the forced air downward to be combined with the hot forced air from a bottom horizontal vent. A baffle plate depending from the top of the fire-box adjacent the flue port and an opening along the top of the doors ignite the gases adjacent the top and directs some gases back into the fire. By forcing heated air at a low level and drawing cool air from a high level, the air being heated is of a uniform temperature. A hood extending along the top edge of the fire box opening diverts exiting gases back into the fire box. A thermostatically controlled blower creates the forced air and cools the fire box walls.

16 Claims, 19 Drawing Figures

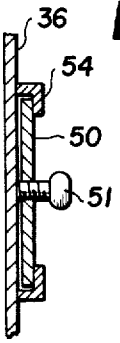
FIG. 2
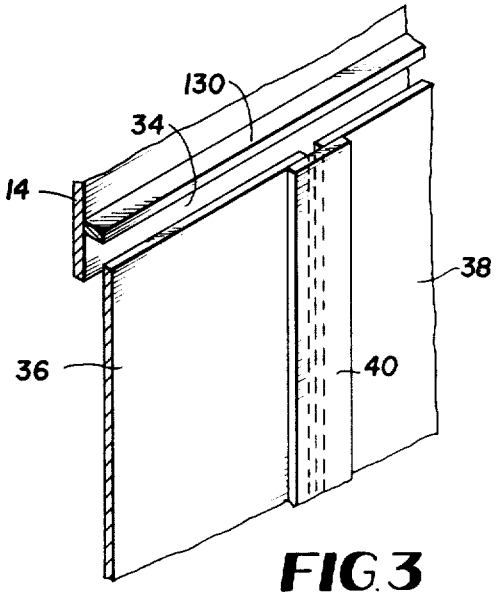
FIG. 3
FIG. 4
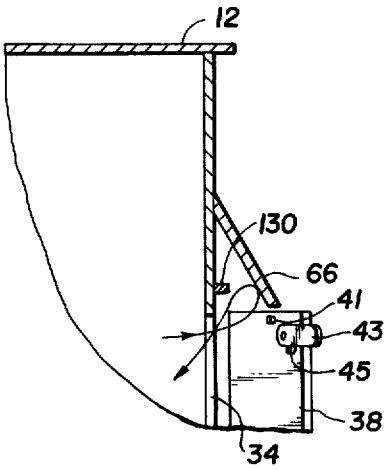
FIG. 7
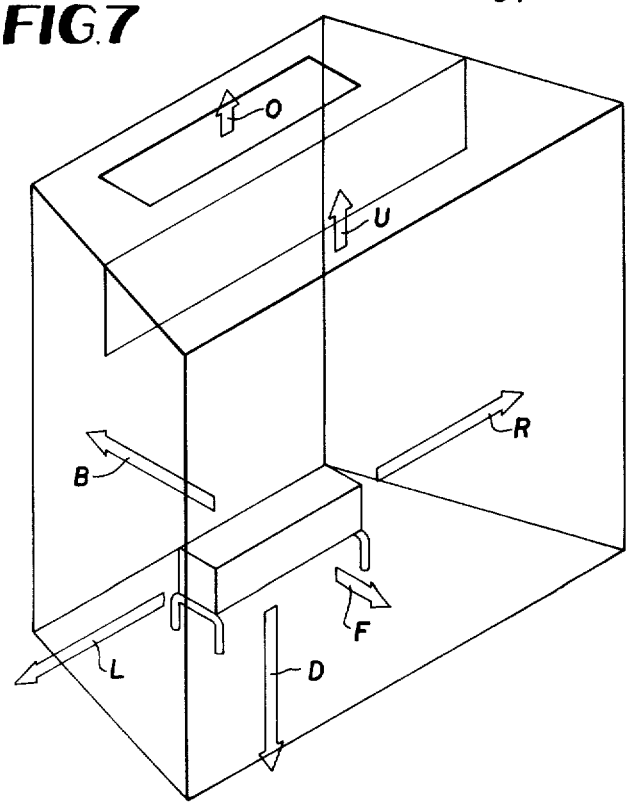
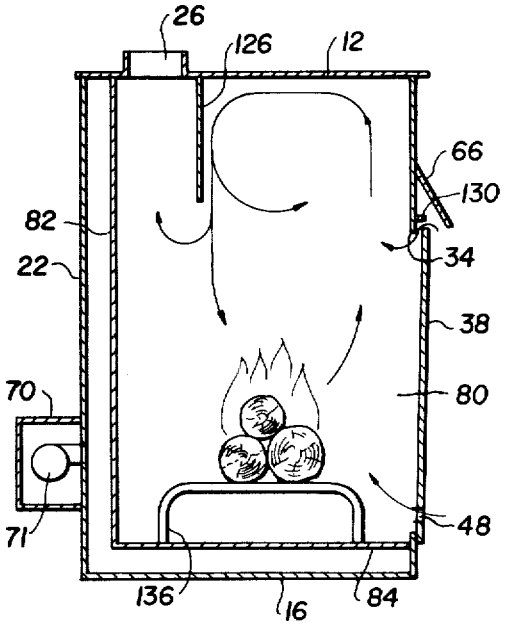
FIG. 8

FIG.6
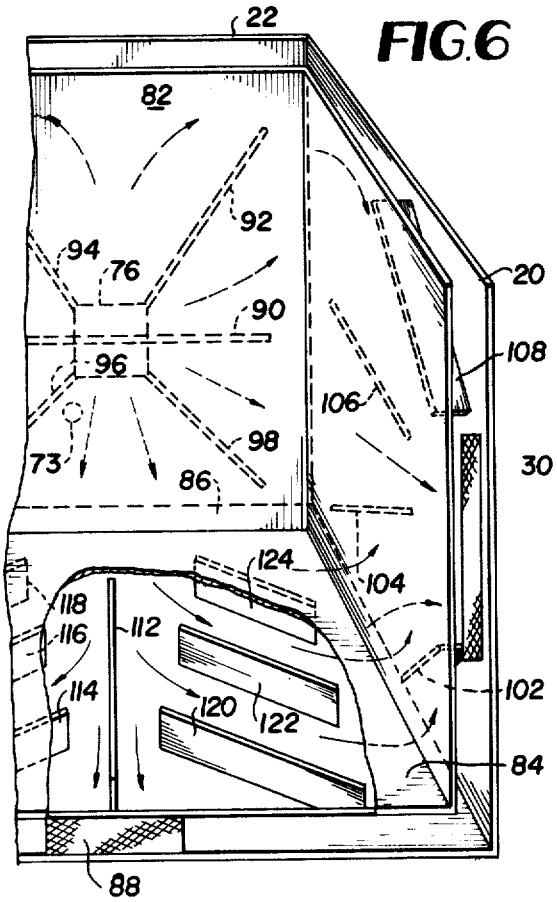
FIG.10
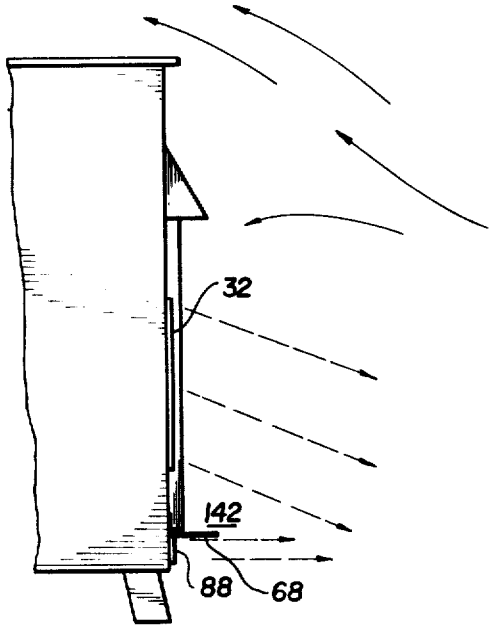
FIG.11
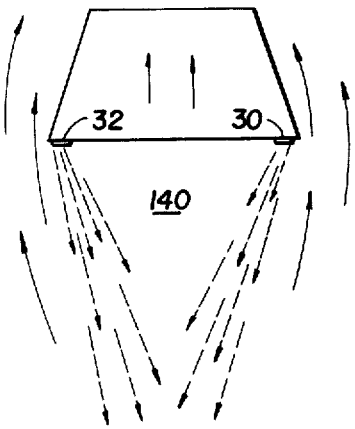
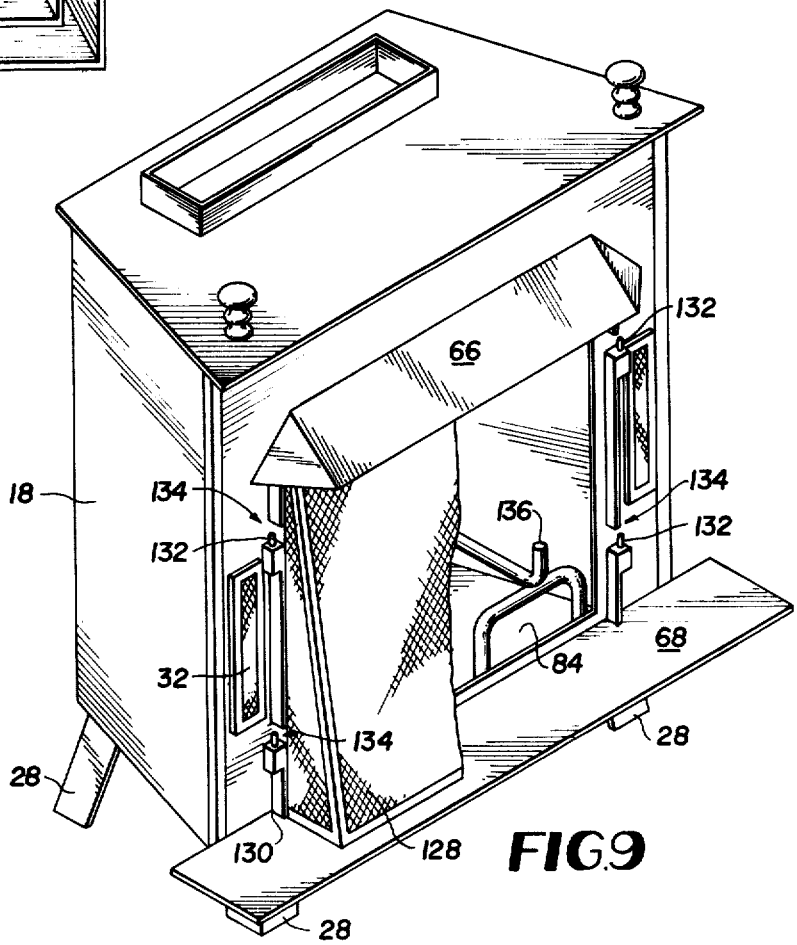
FIG.9

FIG.12
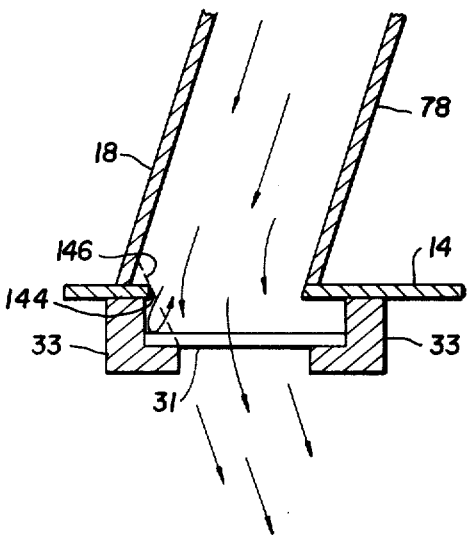
FIG.13
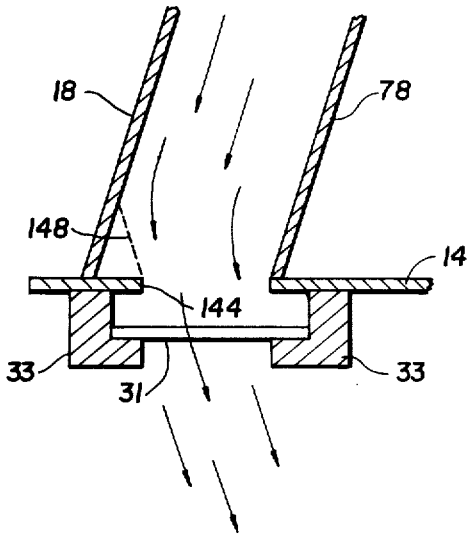
FIG.14
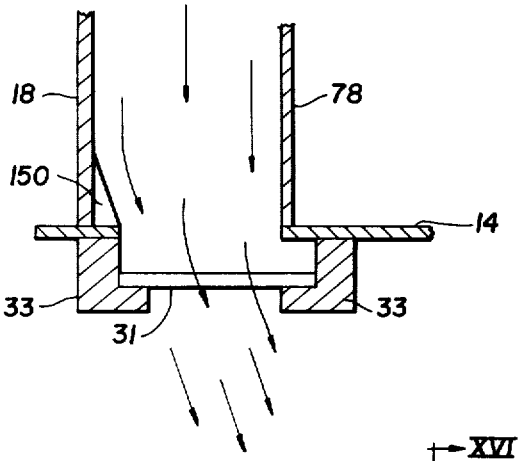
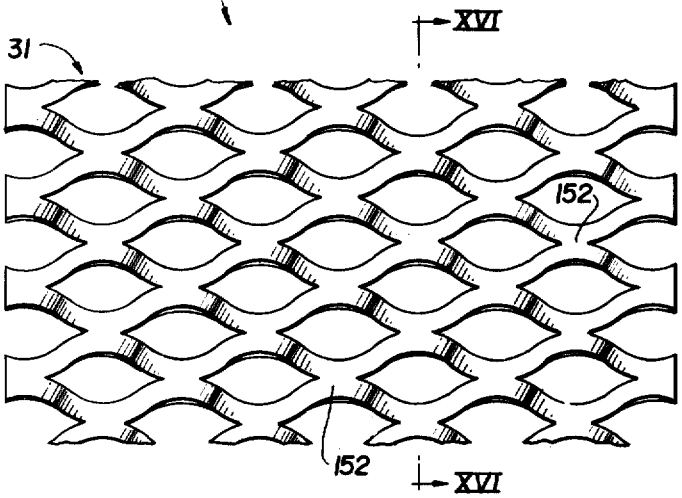
FIG.15
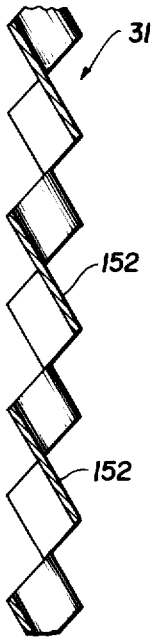
FIG.16

FIG.17
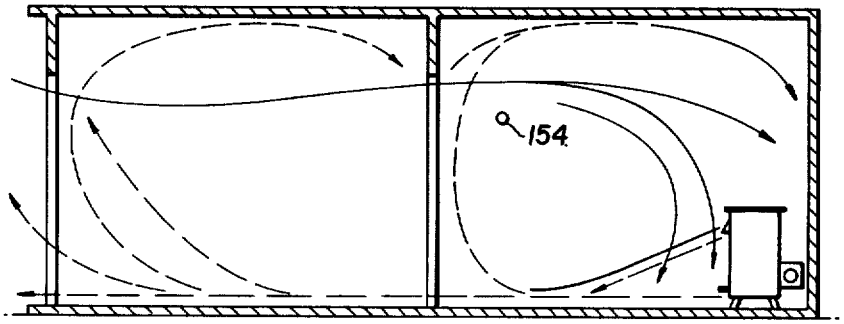
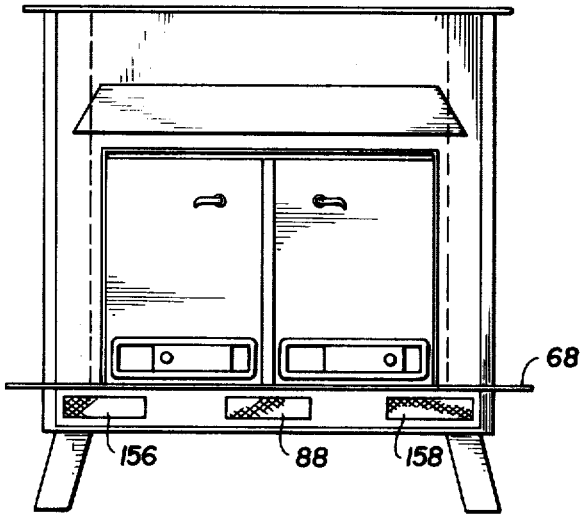
FIG.18
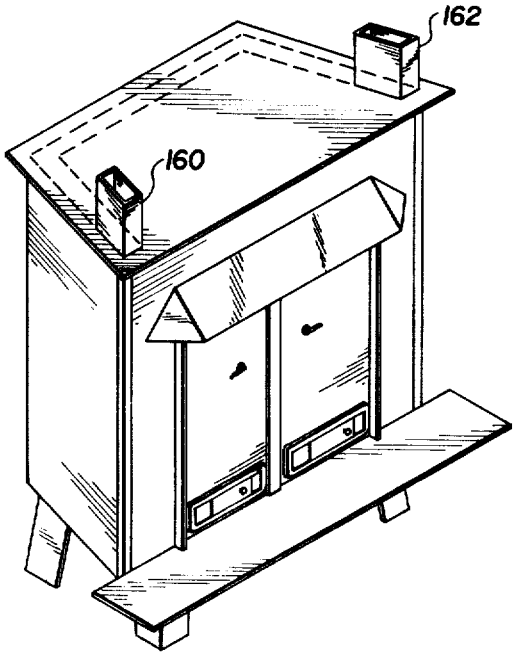
FIG.19

FORCED AIR CHANNEL BAFFLES

CROSS-REFERENCE TO RELATED APPLICATIONS

This application is a continuation-in-part of application Ser. No. 693,805, filed June 7, 1976, now U.S. Pat. No. 4,092,976.

BACKGROUND OF THE INVENTION

1. Field of the Invention

The present invention relates generally to heating units and more specifically to a free standing heater using forced air.

2. Description of the Prior Art

With the energy crisis a great concern, people have generally been preoccupied with maximizing the use of cheap and inexpensive fuels. A major effort has been made to include heat collectors in fireplaces to collect the heat normally generated by the wood burning therein and to transmit it into the room more efficiently than that provided by the normally designed fireplace. A forced air system in combination with such that collectors is shown in U.S. Pat. No. 3,896,785.

Even before the energy crisis, people were concerned with the loss of heat escaping through the flue of a heating source. U.S. Pat. Nos. 1,490,135 and 3,094,980 make use of the flue heat in a stove and fireplace respectively to heat a second column of forced air which is introduced into the room in which the stove or fireplace is located.

Prior art space heaters have also been used or converted to fireplaces to provide a pleasing and second mode of heating. An example of this is shown in U.S. Pat. No. 1,944,626.

Although showing many methods of recapture of heat loss by normal fireplace or space heaters, the prior art has not made the most effective use of the heating source. By concentrating their efforts on hotter fires or recapture of flue gases, the prior art has not effectively captured the heat available from the burning material. No effort is made to limit air flow to the fire and up the flue of a fireplace or open fire box except in closed systems with small intake vents.

Thus there exists a need for a system of limiting air flow into the fire box and up the flue for open fireplaces or fire boxes.

Heating units of the prior art have either used the natural upward flow of heating air by drawing cold air in at the bottom of a heating unit to exit heated from the top. Also, forced air systems have been used to augment the natural upward flow by moving more air past the exterior of the fire box. Although the forced air systems have increased the capture of available heat, the prior art devices have not optimized the heat transfer from the burning material in the fire box to the air circulated about the exterior of the fire box.

The natural flow of drawing cold air in the bottom and exiting hot air from the top or just exiting hot air from the top (naturally or forced) creates a hot layer adjacent the top of the room and a cold layer at the floor. Thus there exists a need for a heating unit which maximizes the capture of heat available in burning material and which provides a more uniform temperature in the room.

The build-up of deposits on the exterior of the fire box in prior art devices result from incomplete combustion of the gases from the burning material. These deposits reduce the thermal convection of the heat in the fire box through the fire box wall. Similarly, the loss of these gases up the flue is a loss of an available source of combustion and additional heat.

Thus there exists a need for a fire box which increases heat and reduces deposits.

Another problem with heating units of the prior art is the escape of smoke and other gases drawn from the fire box by the pressure differential produced by rapidly opening the doors of the fire box.

SUMMARY OF THE INVENTION

The present invention is a forced air heating unit having double walled sides, back, and bottom, and a single walled front and top. A forced air channel, defined by the double sides, back and bottom wall, includes a system of baffles to direct forced air over substantially all of the surface area of the side, back, and bottom fire box walls. The baffles in the back portion of the forced air channel direct forced air between the back portion and the two side and bottom portions. The baffles in the bottom portion direct forced air between the bottom portion and the back and two side portions. The baffles in the side direct forced air between the side portions and the back and bottom portions.

A blower is thermostatically controlled to introduce forced air into the air channel for maintaining the back, side and bottom fire box walls in a minimum temperature range to heat the forced air while maximizing the transfer of heat from the burning material to the forced air channel instead of up the flue.

The front wall of the heating unit includes an access opening and a pair of doors for covering the access opening. An adjustable draft valve in each door includes a positive screw lock. Depending from the top of the fire box adjacent the flue port in the rear of the fire box is a gas baffle for directing rising gas to an area of the fire box where the gases are ignited. The gas baffle directs some of the gas downward to the burning material to be ignited and maintains some of the gases adjacent the top of the fire box in front of the gas baffle. The top of the doors are spaced from the top edge of the access opening to allow air to circulate into the firebox adjacent the top wall for aiding ignition of the gases collected adjacent the top wall. The major source of air is the space between the doors which is covered by a vertical strip mounted to one of the doors. A hood is mounted adjacent the top edge of the access opening for directing gases exiting the top edge of the access opening back into the fire box.

For an open fireplace or fire box, a draft system, including two vertical forced air channel exit vents adjacent the side edges of the access opening for creating hot air drafts which converge at a selected distance in front of the access opening, limits the draft of air into the access opening. The converging hot air is effected by vertical deflection surfaces including vertical baffles in the side portion of the forced air channel or pneumatic surfaces produced by a lip extending across the vent opening or by the vent opening being offset from the exterior edge of the forced air channel. The less than ninety degree angle that the side walls form with the front of the forced air channel also aids the deflection. A mesh having inclined horizontal surfaces covers the vertical vents and directs the exiting air downward to be combined with heated forced air exiting horizontal vent in the front of the bottom portion of the forced air channel. The heated forced air from the two vertical vents and the horizontal vent pneumatically create a finite cool air pocket in front of the access opening to limit the amount of cool air available for the fire box.

The forced air heating unit uniformly heats a room by introducing forced hot air adjacent the floor of the room by the horizontal vent and the downward directing vertical vents. The forced air device mounted to the rear of the free-standing unit draws air from above and around the sides of the unit and around the space defined by the exiting forced hot air. The width of the side portion of the forced air channel tapers from the wider rear portion of the front to increase the air intake. Gravity lock door handles are provided on the access doors.

OBJECTS OF THE INVENTION

An object of the present invention is to provide a forced air heating unit which maximizes the capturing of the heat available in the burning material.

Another object is to maximize the heat transfer of the system while sufficiently heating forced air.

A further object is to maximize heat transfer by thermostatically controlling the forced air device.

An even further object is to maximize heat transfer by forced air flow over substantially all the back, two sides and bottom wall of a fire box.

A still further object is to reduce deposit build-up on the walls of the fire box by igniting unused gases.

A still even further object is to prevent smoke from escaping the fire box by rapid opening of the doors.

An even further object is to limit the air flow toward the open fire box by a forced air barrier.

A still further object is to provide a free-standing unit which uniformly heats a room.

Still another object of the invention is to provide a forced air heater having the objects enumerated, which is free-standing and safe for use in the home.

Other objects, advantages, and novel features of the present invention will become apparent from the following detailed description of the invention when considered in conjunction with the accompanying drawings.

BRIEF DESCRIPTION OF THE DRAWINGS

FIG. 2 is a partial cross-sectional view of the draft valve taken along lines II—II of FIG. 1.

FIG. 3 is an exploded, partial perspective view of the relationship of the top of the doors to the fire box opening.

FIG. 4 is a partial side view illustrating the function of the hood according to the present invention.

FIG. 6 is a front partial perspective of the bottom, back, and side walls of the forced air heating unit illustrating the baffle system.

FIG. 7 is a perspective schematic of the heat flow in the fire box.

FIG. 8 is a side cross-sectional view illustrating gas circulation in the fire box.

FIG. 9 is a front perspective of a fireplace employing the principles of the present invention.

FIG. 10 is a side view illustrating the forced air pattern according to the principles of the present invention.

FIG. 11 is a plan view illustrating the forced air pattern according to the principles of the present invention.

FIG. 12 is an enlarged plan view of a vertical vent illustrating the deflecting principle of the present invention.

FIGS. 13 and 14 are enlarged plan cross-sectional view of alternative embodiments of vertical deflectors.

FIG. 15 is a front view of the mesh used in the vents.

FIG. 16 is a cross-sectional view taken along lines XVI—XVI of FIG. 15.

FIG. 17 is a schematic of the air circulation produced by the present invention.

FIG. 18 is a front view of another embodiment of the principles of the present invention.

FIG. 19 is a perspective of another embodiment of the present invention.

DESCRIPTION OF THE PREFERRED EMBODIMENTS

Figure 1:
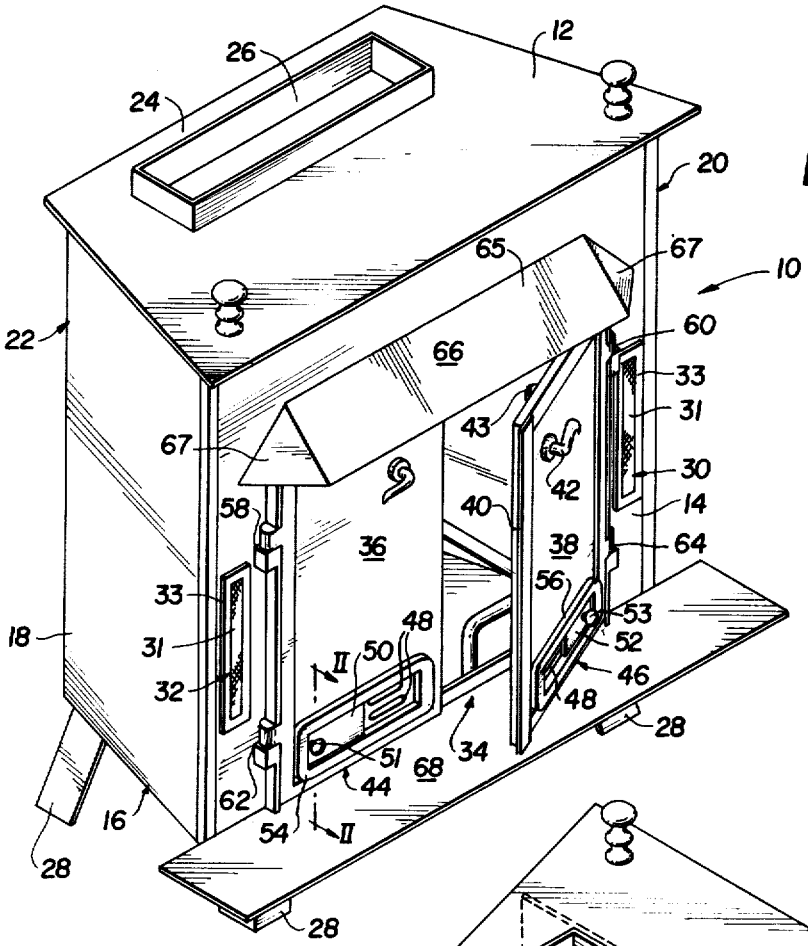
FIG. 1 is a front perspective view of a forced air heating unit employing the principles of the present invention.

FIG. 1, which illustrates a preferred embodiment of the forced air heating unit 10, shows a housing having top, front, bottom, two sides, and back walls, 12, 14, 16, 18, 20, and 22 respectively. Top wall 12, which is a single walled portion of the housing, extends past the front, back, and side walls, and includes a collar 24 surrounding an orifice or flue port 26. A flue (not shown) to remove the fumes from a source of heat or combustible material is connected to flue port 26 through the collar 24. The heating unit 10 is supported by four legs 28 providing space between the floor and the bottom wall 16. Front wall 14 has a pair of elongated vertical vents 30 and 32, each covered by a screen 31 which is secured to the front wall 14 by a bracket or lip 33.

An access opening 34 in front wall 14 is covered by a closure including a pair of doors 36 and 38. The vertical vents 30, 32 extend substantially the height of the opening 34 and are spaced from the bottom and top of the opening 34. The door 38 has a strip 40 which overlaps door 36 and holds door 36 closed and covers the space between the adjacent edges of the doors. Handle 42 on door 38 is connected to a latch 43 which engages the top interior portion above the opening 34 so as to lock the doors closed. The handle 42 rotates down to close, thus providing a gravity lock of the doors. A pair of posts 41 and 45 on the interior of the doors 38 provides stops for latch 43. Post 41 may be mounted to the interior of front wall 14 if desired.

Figure 5:
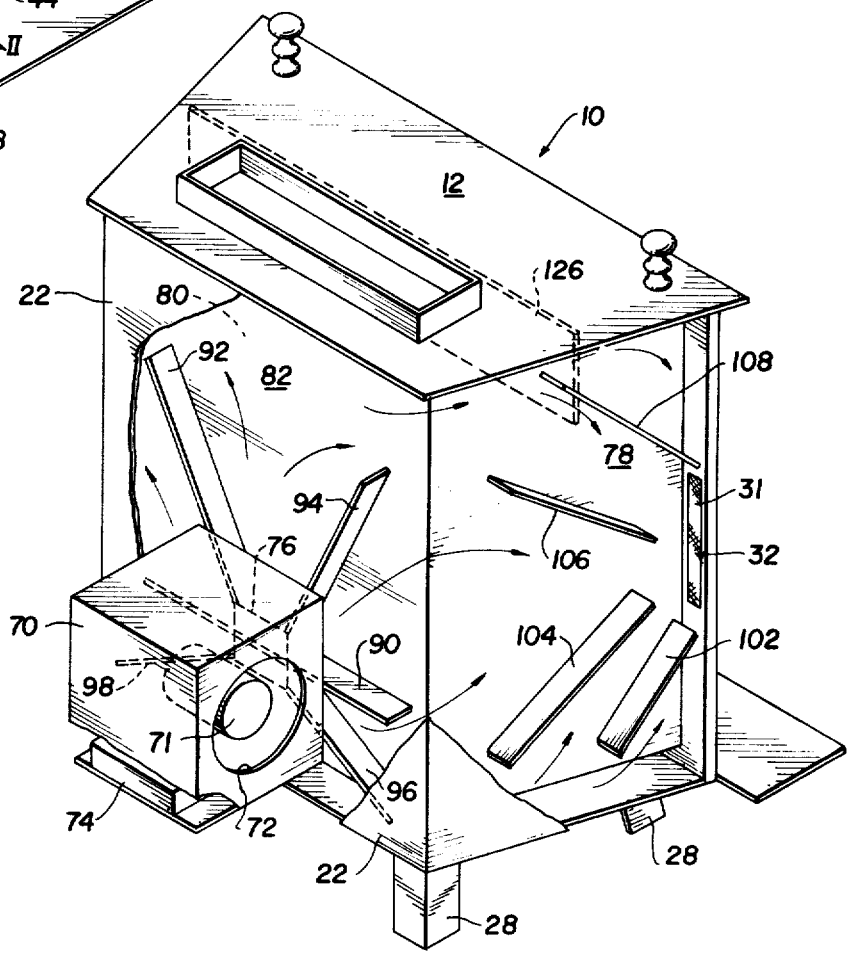
FIG. 5 is a rear cutaway perspective of the forced air heating unit illustrating the baffle system.

Also provided on doors 36 and 38 are a pair of draft valves 44 and 46. The sliding portions 50 and 52 of draft valves 44 and 46 slide within guide members 54 and 56 to adjust the size of a plurality of elongated openings 48 in doors 36 and 38. When a fire is provided in the interior chamber of housing 10, the slides 50 and 52 adjustably vary the draft valves 44 and 46 to regulate the amount of air or draft introduced into the chamber and are locked in the adjusted position by threaded knobs 51 and 53 respectively engaging the face of doors 36 and 38 respectively as illustrated in FIG. 2. For a wood burning source of combustible material, this would vary the rate of burning as well as the temperature. These valves are used in conjunction with an adjustable flue port 26. Although the draft valves 44, 46 are shown in the doors 36, 38, they may also be used on a front wall of the five box below the doors if such a surface is made available. The doors 36 and 38 are mounted to the housing by upper hinges 58 and 60 and lower hinges 62 and 64, respectively. The doors and hinges are dimensional so that the bottom of doors 36, 38 rest flush against the front wall 14 and the top of doors 36, 38 are spaced from the front wall 14 at the top edge of opening 34 as illustrated in FIGS. 5 and 19. The importance of this separation will be discussed below in reference to FIGS. 3 and 8.

Also mounted to the front wall 14 is a hood 66 and a platform 68. The hood 66 traps any smoke pulled from the fire box at the upper edge of access opening 34 when the doors 36, 38 are rapidly opened and directs it bsack into the fire box as illustrated in FIG. 4. The hood 66 includes a center portion 65 and a pair of side portions 67 for capturing the escaping gases and directing them back into the opening 34. The platform 68 provides a surface for supporting a fireplace screen when the heating unit 10 is used as a fireplace without doors.

The forced air system includes a source of forced air, a channel, a baffle system, and deflectors. The source of forced air, including a housing 70, is mounted to the back wall 22 and includes an opening 72. Located within the housing 70 is a blower 71 or any other system which will receive air through opening 72 and provides a forced air flow within the channels to be described. A thermostatic control 73 is mounted in rear wall 22 (FIG. 6) and controls the operation of fan 71 based on the temperature of the air in the forced air channel. Housing 70 may also contain a source of moisture which is illustrated in FIG. 5, for example, as a pan 74 having water therein. The pan of water is merely one example of a source of moisture. Forced air housing 70 communicates with the forced air channels via an inlet 76 in the back wall 22.

Although the location of inlet 76 and blower 71 on the back wall is preferred for most applications, they may be located any place which provides them access to the forced air channel. For example, inlet 76 and blower 71 could be on either side wall 18, 20 or on top 12 over the back or either side portion of the forced air channel. Similarly, they may be on the front wall 14 with access to the two side or bottom portion of the forced air channel.

The air channel of the present device includes the exterior sides, back, and bottom alls 18, 20, 22, and 16 respectively and interior sides, back, abd bottom walls 78, 80, 82, and 84 respectively. The sides and back walls of the housing and the sides and back interior walls form a generally U-shaped forced air channel with the side walls at an angle other than ninety degrees relative to the back where the forced air from opening 76 is transmitted towards front vents 30 and 32. The separation of the side walls 18 and 78 and 20 and 80 or the width of the side forced air channel tapers or diminishes from the rear to the front. The increased width of the back air channel and the rear of the side air channel allows blower 71 to pump more air per minute into the forced air channel. The forced air from opening 76 is also provided from the rear forced air channel through an opening 86 into the forced air channel formed by the housing and the interior bottom walls to exit through horizontal vent 88, illustrated in FIG. 6, in the front portion of the bottom air channel. The air in the bottom forced air channel also exits into the side forced air channels. Thus it can be seen that forced air traverses substantially the total surface of the interior back, side, and bottom walls.

Within the forced air channels are baffle systems to create specific air patterns which diverge from the forced air source at opening 76 and converge on the respective vents in the front of the air channels. The rear wall portions of the baffle system includes a horizontal baffle 90 substantially bisecting opening 76 from the forced air system. Also provided in the rear wall are two upper baffles 92 and 94 and two lower baffles 96 and 98 which diverge from the forced air opening 76. Baffles 94 and 96 direct divergent air flow towards one side wall channel while baffle 92 and 96 in combination direct diverging air flow toward the other side wall channel. Upper baffles 92 and 94 direct an upward flow towards the respective side wall channel portions and baffles 96 and 98 provide a flow towards opening 86 into the bottom forced air channel as well as providing a small flow to the respective side forced air channel.

Located in each side forced air channel are baffles 102, 104, 106, and 108, and in bottom forced air channel are baffles 112, 114, 116, 118, 120, 122, and 124. The inner ends of bottom baffles 114, 116, 118, and 120, 122, 124 are offset relative to the center bottom baffle 112 so as to divert varying portions of the air flowing towards bottom vent 88 and to direct it towards side wall baffles 102 and 104. The angle and location of baffles 114, 116, 118, 120, 122 and 124 are such that the air between baffles 114–116 and 120–122 is directed toward the lower face of side baffle 102; and the air between baffles 116 and 122 and the rear of the bottom is bisected by baffles 118 and 124 respectively and directed beteeen baffles 102 and 104. Since the source of the temperature modification is generally placed adjacent interior bottom wall 84, the communication of the air flow from the bottom forced air channel to the side forced air channel increases the efficiency of the temperature transfer.

The specific design of the baffles and their location assures that the air traverses substantially all the interior walls and thereby allows a greater heat transfer from the interior or fire box to the forced air without sacrificing the head of the air emitting from the vents 30, 32, and 88 since it cools a greater surface area. Prior art devices generally substantially increase the length of the air path while sacrificing the head of the air at the vents and thereby reducing the heat transferability of the interior walls. The baffle system in the walls produce streams of air which are not troubled by eddy currents, dead air pockets, localized hot spots, and other disadvantageous features of the prior art systems.

Blower 71 is chosen to have sufficient capacity to force air in the air channel at a sufficiently high velocity to lower the temperature of the interior walls and thereby increase the transfer of heat from the fire box to the interior walls to be removed by the forced air. Thus less heat from the fire box is available for transmission up the flue. For a heating unit eighteen inches high without legs by twenty-three inches wide at the front by fourteen inches deep, a blower having a capability of pumping 140 cubic feet of air per minute is sufficient. A blower pushing 465 cubic feet per minute is adequate for a unit twenty-seven inches high by forty-two inches wide by twenty inches deep.

An analysis of the thermodynamics of the heating unit 10 will substantiate the efficiency or maximization of heat transfer or capture of the unit. The formula for representing the heat transferred from the heated air in the fire box through the interior walls to the forced air in the forced air channels is:

$$Q = A\ U\ \Delta T$$

where

Q=heat transferred in BTU/hour;

A=effective heat-transfer surface area perpendicular to the direction of heat flow in feet square;

ΔT=mean temperature difference between the forced air and the fire box air in degrees fahrenheit;

W=overall heat-transfer coefficient in BTU/(hour)-(feet)$^2$(° F.)

The overall heat transfer coefficient U is a function of the resistance to the flow of heat of (a) the air in the fire box, (b) the firebox wall, (c) the forced air, and (d) the fouling on each side of the fire box wall.

One way to maximize the transfer of heat is to create as great as possible temperate differential ΔT. The blower 71 in combination with thermostat control 73 maintain the back, two sides, and bottom wall of the fire box in a range of temperature to maximize the heat transfer through the fire box walls while heating the forced air to a sufficiently warm temperature. For example, thermostat 73 could turn blower 71 on once the temperature in the forced air channels is 115° F. and turn the blower 71 off when the forced air temperature is reduced below 100° F. If desired, the thermostat control 73 could vary the speed of blower 71. The preferred range is 95° F. to 150° F.

By forcing air over substantially all the back, two sides, and bottom fire box walls, heating unit 10 substantially maximizes the effective surface area A at the greatest temperature differential. This area could be further increased by extending the forced air channel over the top wall 12 of the fire box, if desired, but is not preferred.

The heat flow within the fire box is also based on the above equation except that the temperature differential ΔT should be expressed as a temperature gradient or the change in temperature per unit distance. The amount of heat flow is illustrated in FIG. 7 by the length of the vecotr. Since the bottom forced air channel, being the closest cool surface, has the largest gradient or vector D. The forced air cooled two side and back walls, being substantially equidistant from the fire, have the next largest vectors L,R, and B, respectively. The front wall, being a nonforced air wall, can only cool by heat dissipation. Thus, the temperature gradient toward the front wall, and consequently the heat flow F, is substantially less than those toward the forced air cooled walls. Similar to the front wall, the top wall is not forced air cool and thus has a small heat flow U. Since gas ignition occurs adjacent the top (as will be discussed for FIG. 8), the surface of the top wall is even hotter than the front wall and consequently vector U is smaller than vector F. With a limited air flow up the flue, there is very little heat left to exit the flue port as illustrated by vector O.

Thus the thermostatically controlled blower maximizes the surface area of maximum temperature differential to effectively capture or draw eighty percent of the heat available from the fire box into the forced air channel. This is comparable to the heat efficiency of a residential furnace.

To maximize the heat transfer coefficient of the unit 10, a device is provided to reduce the build-up of deposits on the fire box wall by igniting the rising gased from a wood fire. This ignition also increases the amount of heat available from the wood. This device includes a gas baffle 126 extending down from the top wall 126 adjacent the flue port 26 as illustrated in FIG. 8.

With the doors 36, 38, closed, the slide drafts 44, 46 on the doors allow a controlled, even flow of air across the fire. As the wood is burned, the unburned gases rise from the fire up and slightly forward, to the top wall 12. As they contact the top wall 12, they circulate to the rear of the fire box, toward the flue port 26 and contact baffle 120 which deflects the gases downward. At this point, some will go under the baffle 126 and out the flue port 26, some will be pulled back into the fire and reburned, and some will be recirculated at the top 12 by the gases rising from the fire.

Approximately 30 seconds after an even fire has been established, a rolling cushion of smoke (partially burned gases) will build up under the top wall 12. This cushion acts to hold the resins and gases in the fire to burn longer and holds the gases in the fire box until they are recirculated and burned as completely as possible.

As the wood gases rise away from the fire, they cool quite rapidly. In order to prevent the cooling gases from liquefying and building up creosote deposits inside the fire box, and later in the chimney, a small amount of secondary air is injected at the top of the doors 36, 38. The secondary air injection ignites the gases directly under top wall 12. This secondary burning action more completely burns the gases and raises the temperature of the smoke escaping up the chimney sufficiently to prevent the solids in the smoke from separating and building up inside the chimney. This action also raises the temperature of the top wall 12 to cooking level.

The space between the two doors 36 and 38 and the mounting of the doors 36 and 38 so that the top edges of the doors are spaced from the top edge of the access opening 34 permits the secondary air flow into the area adjacent the top wall 12 aiding the ignition of gas collected there. Although the air space is provided by the tops of the doors being offset from the plane of the front wall 14, this space may also be provided by making the top of the doors shorter than the access opening 34.

The forced air heating unit 10, as illustrated in FIG. 9 may be used as afree standing fireplace. The doors 36 and 38 are removed and a screen 128 is provided underneath hood 66 and resting on platform 68. The screen may be a typical fireplace screen to prevent sparks and ashes from emitting from the fireplace and causing a fire hazard within the room. Adjacent to and surrounding openings 34 is a rim 130. Four pins 132 of hinges 58, 60, 62, 64 are provided on the rim 130 as well as four openings 134 in the rim. The matching hinge element of the closures 36, 38 move in and out of the openings 134 in the rim 130. In addition to providing the pin portion 132 of the hinges for the closures 36 and 38, the rim 130 provides a guide and retainer for the screen 128 which fits within the rim 130. Though not shown, the rim 130 extends above and across the top of the opening 34. A pair of andirons 136 are provided in the interior chamber to support the source of temperature modification. It should be noted that grating or other supports may be used instead of andirons 136.

The forced air heating device 10 includes a system of deflectors at the vertical vents 30 and 32 to define a unique air flow pattern in front of the fire box opening 34. As illustrated in FIGS. 10 and 11, the heated forced air (dashed lines) from vertical vents 30, 32 are directed towards each other to converge in front of the fire box opening 34 a preselected distance. This creates an air pocket 140 in front of the fire box opening 34 in combination with the heated forced air exiting the bottom horizontal vent 88 which is illustrated in FIG. 10 but deleted from the pattern of FIG. 11 for sake of clarity. The pneumatically created barrier or air pocket 140 limits the amount of air from which the fire can draw and thereby reduces the rate of combustion in the fire box. Also, the outward moving heated air reduces cold air drafts toward the access opening 34. The V-shaped pneumatic barrier is a critical substitute for the open or removed doors 36 and 38.

The major source of cool air (solid lines) for the pocket 140 in front of the fire box is the triangular aerodynamic openings 142 between the bottom of the vertical vents 30, 32 and the forced air from the horizontal vent 88. The forced hot air from vertical vents 30, 32 also is directed downward, as well as inward to converge, allowing air to flow into the pocket 140 over the top edge of the forced hot air V. The two vertical air streams converge preferably at about five feet in front of the access opening. To converge much closer would draw smoke from the fire box.

Blower 71 on the back wall draws air as indicated by the solid lines around the sides of the unit and over the top. Thus the cool or return air flow is outside the air pattern defined by vents 30, 32 and 88 which pneumatically block cool air flow into the fire box.

A preferred device for directing the air exiting the vertical vents 30 and 32 to converge is illustrated in the enlarged view of FIG. 12. The side walls 18 and 78 are mounted to the front wall 14 at an opening 144 in the front wall. While side wall 78 lies at the edge of the opening 144, side wall 18 is slightly offset. This offset may be eliminated. The side walls 18, 78 form an angle less tha ninety degrees with the front wall 14 to aid the deflection of forced air inward. The bracket 33 is generally L-shaped having a portion extending across the opening 144. The bracket 33 forms an air pocket along the outside edge of opening 144 which is a pneumatically produced deflection surface 146. The pneumatic deflection surface exterior the forced air channel is sufficient to direct the heated forced air to converge in front of the fire box access opening 34.

Two alternative embodiments are illustrated in FIGS. 13 and 14. In lieu of the external pneumatic deflector 146, an internal pneumatic deflector could be used. As shown in FIG. 13, the exterior side wall 18 is substantially offset from the edge of opening 144 providing pneumatically produced deflection surface 148. FIG. 14 shows a vertical deflection plate or baffle 150 mounted between the exterior side wall 18 and front wall 14. The side forced air channels form a ninety degree angle with the front wall, although the non-ninety degree angle alignment is preferred. Each embodiment may also include the pneumatical deflection surface 146 produced by the L-shaped bracket 33.

The downward air flow is produced by the mesh 31 secured to that L-shaped bracket 33 across vent opening 144. As illustrated in FIGS. 15 and 16, the mesh 31 includes a plurality of horizontal surfaces 152, at the intersection of adjacent openings, inclined downward from the back to the front to deflect air downward without retarding the air flow through the mesh 31. If the downward deflection is not required, mesh 31 may be mounted with the surfaces 152 vertical to provide the converging air flow. Basically, the mesh 31 may be mounted with any desired orientation of the surfaces 152 to produce a correspondingly directed air flow (e.g. 45° angle relative to the horizonal).

The forced hot air patterns converging just off the floor in front of the unit push the warm air across the floor. When the forced air strikes a wall, it is deflected to either side and up. At the same time, the blower 71 is pulling return air to either side and down over the top of the unit. This push-pull action results in a high volume of air movement as the blower system forces hot air across the floor and returns cool air around either side and overhead. This is exactly the opposite of normal air movement within a house and results in a more uniform temperature from floor to ceiling. The air patterns are illustrated in FIG. 17 where the solid lines represent cool air and the dashed lines represent warm air.

A thermostat 154 may be provided in the room to be heated. Whereas thermostat control 73 preferably turns the blower on and off as a function of the air temperature in the forced air channel, thermostat 154 varies the speed of the blower as a function of the air temperature in the room to be heated. The use of a room thermostat increases the comfort in the room, but reduces the efficiency of the unit 10 since the fire box walls may not be kept at the lowest possible temperature.

Although the vertical vents 30 and 32 are preferred so that the heating unit 10 could be used as a fireplace or operated with the doors open, they may be eliminated. The flow pattern of FIG. 17 may also be produced by using only vents in the front of the bottom forced air channel. As illustrated in FIG. 18, two additional vents 156 and 158 are provided on each side of vent 88. The pushing of warm air adjacent the floor and pulling cool air from above evenly heats the room.

The heating unit 10 could also be used as a furnace. As illustrated in FIG. 19, top vents 160 and 162 may be connected to the plentum or duct system to be transmitted throughout a house. In either of these two embodiments, the baffle system is modified so as to direct air over the substantially all the surfaces and towards the vents without forming dead air pockets in the forced air channel.

Although reference has been to wood fires, the heating unit 10 is effective for use with coal, oil, gas, or any other heat source in the fire box.

Preferred method of assembly of the forced air heating unit 10 is to form the exterior side and back walls 18, 20, and 22, out of a single piece of material and the interior side and back walls 78, 80, and 82 also out of a single piece of material. The baffles are mounted to the exterior side and back walls and the interior side and back walls are mounted to the baffles preferably by welding. The bottom exterior wall 16 is welded to the exterior side and back walls 18, 20, 22, and the baffles of the bottom forced air chamber are mounted to the bottom exterior wall. The bottom interior wall 84 is then joined to interior side and bac walls 78, 80, 82. The top and front walls are then mounted to the structure by welding. The welding bead formed between the top and the side and back walls provides a thermal barrier or guard such that the portion of the top 12 which extends beyond the side and back walls cooler than a portion of the top which is directly over the fire box. The remaining elements are attached or mounted to the front wall and the forced air unit mounted to the rear wall.

It is suggested that the interior side and back walls 78, 80, and 82 be made of 3/16 inch thick steel and the exterior side and back walls as well as the top and front walls be made of ⅛ inch thick steel. The bottom exterior and interior walls may be made of 3/16 inch steel. The selection of different thicknesses of steel provides for a maximum absorption of the heat of the interior chamber as a heat exchanger to be used in contact with the forced air which cools the interior walls while taking advantage economically of thinner exterior walls.

From the preceding description of the preferred embodiments, it is evident that the objects of the invention are obtained. A forced air heating unit is provided which maximizes the use of available heat from a fire box by a unique thermostatically controlled forced air system including pneumatically produced surfaces and barriers. Although the invention has been described and illustrated in detail, it is to be clearly understood that the same is by way of illustration and example only and is not to be taken by way of limitation. The spirit and scope of this invention is to be limited only by the terms of the appended claims.

What is claimed:

1. A fireplace comprising:

a chamber for holding a source of heat;

a forced air channel surrounding a back wall, side walls and a bottom wall of said chamber, said channel including substantially the entire back wall, said two side walls and said bottom wall of said chamber;

the back portion of said forced air channel communicates with the two side and bottom portions of said forced air channel and said bottom portion communicates with said two side portions;

a vent means in the front of said forced air channel;

means for forcibly introducing air into said back portion of said air channel and over substantially the entire surface of said back wall of said chamber; and baffle means interior said back, two side and bottom portions of said channel for directing forced air from said back portion to said two side portions, and over substantially the entire side walls and from said back portion to said bottom portion and over substantially the entire bottom wall and from the bottom portion to said side portions to said vent means in the front of said forced air channel.

2. The fireplace according to claim 1 wherein said means in said back portion includes baffles extending radially from the inlets for said introducing means to direct air over said back portion and said side and bottom portions.

3. The fireplace according to claim 1 wherein said means in said side portion includes baffles radially extending from a vent means in the front of said side portion to direct air over said side portion from said back and bottom portions to said vent means.

4. The fireplace according to claim 1 wherein said means in said bottom portion includes baffles for directing air from said back portion over said bottom portion to said side portions.

5. The fireplace according to claim 4 wherein said baffles in said bottom portion direct air to a vent in the front of said bottom portion.

6. A heating unit comprising:

a fire box;

a unitary forced air channel along a back and two side walls of said firebox, said channel including substantially the entire back wall and substantially the entire two side walls of said firebox;

an inlet in the back wall portion of said forced air channel and outlets in the side wall portions;

means for forcing air from said inlet to said outlets through said forced air channel;

first baffle means in said back wall portion for radially directing the forced air from said inlet over substantially the entire surface of said back wall of said fire box toward both side wall portions and over substantially the entire side walls of said fire box; and second baffle means in said side wall portions for radially directing the forced air in said side portions of said forced air channels toward said outlets.

7. The heating unit according to claim 6 wherein said first baffle means includes baffles radially extending from said inlet and said second baffle means includes baffles extending from said outlet.

8. The heating unit according to claim 6 wherein said forced air channel includes a bottom portion along the bottom wall of said fireplace and said bottom portion includes third baffle means for directing air from said back portion over said bottom wall of said fire box to said side wall portions.

9. A heating unit comprising:

a fire box;

forced air channels along a back, bottom and two side walls of said fire box;

an inlet in the back wall portion of said forced air channel and outlets in the side wall portions;

means for forcing air from said inlet to said outlet through said forced air channel;

first baffle means in said back wall portion for radially directing the forced air from said inlet over said back wall of said fire box;

second baffle means in said side wall portions for directing the forced air to said outlet from said back wall portion over the side wall of said fire box; and third baffle means in said bottom wall portion including two sets of baffles on each side of the center of said bottom portion, the baffles in a set are substantially parallel to each other and the ends of said baffles adjacent said center are staggered relative to said center.

10. The heating unit according to claim 9 wherein said bottom portion includes an outlet in the front of said bottom portion and a baffle along said center.

11. A fireplace comprising:

a chamber for holding a source of heat;

a forced air channel surrounding a back, two sides and bottom of said chamber;

the back portion of said forced air channel communicates with the two side and bottom portions of said forced air channel and said bottom portion communicates with said two side portions;

a vent in the front of said forced air channel;

means for forcibly introducing air into said back portion of said air channels; and means interior said back, two side and bottom portions for directing forced air from said back portion to said two sides and to said bottom portion and between said two sides and bottom portions to said vent in the front of said forced air channel;

said directing means including two sets of baffles on each side of the center of said bottom portion, the baffles in a set are substantially parallel to each other and the ends of said baffles adjacent said center are staggered relative to said center.

12. The fireplace according to claim 11 wherein said bottom portion includes a vent in the front of said bottom portion and a baffle along said center.

13. A heating unit comprising:

a fire box;

forced air channels along a back and two side walls of said fire box;

an inlet in the back wall portion of said forced air channel and outlets in the side wall portions;

means for forcing air from said inlet to said outlet through said forced air channel;

first baffle means in said back wall portion for radially directing the forced air from said inlet over said back wall of said fire box;

second baffle means in said side wall portions for radially directing the forced air to said outlet from said back wall portion over the side wall of said fire box; and said fire box includes an opening in a front wall for providing access, and said outlets are adjacent the sides of said opening to surround substantial portions of said sides of said access opening with exiting forced air.

14. A firebox comprising:

a chamber for holding a source of heat;

a forced air channel surrounding a back, two sides and bottom of said chamber;

the back portion of said forced air channel communicates with the two side and bottom portions of said forced air channel and said bottom portion communicates with said two side portions;

a vent means in the front of said forced air channel; means for forcibly introducing air into said back portion of said air channels;

means interior said back, two side and bottom portions for directing forced air from said back portion to said two sides and to said bottom portion and between said two sides and bottom portions to said vent means in the front of said forced air channel; and said fire box includes an opening in a front wall for providing access, and said vent means includes a pair of vents adjacent the sides of said opening and a vent adjacent the bottom of said opening to surround substantial portions of said sides and bottom of said access opening with exiting forced air.

15. The heating unit according to claim 14 wherein said directing means direct air to converge on said vents.

16. The heating unit according to claim 14 including a horizontal plate extending from said front wall separating said access opening and said bottom vent.

* * * * *